United States Patent [19]

Appleman

[11] Patent Number: 4,566,406

[45] Date of Patent: Jan. 28, 1986

[54] SLUDGE REMOVING APPARATUS FOR A STEAM GENERATOR

[75] Inventor: Robert H. Appleman, Pleasant Hills, Pa.

[73] Assignee: Westinghouse Electric Corp., Pittsburgh, Pa.

[21] Appl. No.: 513,209

[22] Filed: Jul. 13, 1983

[51] Int. Cl.[4] ..... F22B 37/48

[52] U.S. Cl. ..... 122/405; 122/32; 122/383; 122/390; 376/310

[58] Field of Search ..... 122/379, 381–385, 122/388, 390, 392, 397, 405, 32; 165/95; 376/310 X, 316

[56] References Cited

U.S. PATENT DOCUMENTS

| | | | |
|---|---|---|---|
| 1,127,354 | 2/1915 | Eckliff | 122/383 |
| 2,290,368 | 7/1942 | Dutton | 122/405 |
| 3,916,844 | 11/1975 | Cassell | 122/381 |
| 3,942,481 | 5/1976 | Bennett | 122/383 |
| 4,037,569 | 7/1977 | Bennett et al. | 122/383 |
| 4,079,701 | 3/1978 | Hickman et al. | 122/382 |
| 4,131,085 | 12/1978 | McDonald | 122/382 |
| 4,158,387 | 6/1979 | McDonald | 122/381 |
| 4,261,300 | 4/1981 | Cross et al. | 122/388 |
| 4,273,076 | 6/1981 | Lahoda et al. | 122/382 |
| 4,407,236 | 10/1983 | Schukei et al. | 122/390 |
| 4,452,183 | 6/1984 | Yazidjian | 122/390 |

FOREIGN PATENT DOCUMENTS

| | | | |
|---|---|---|---|
| 677391 | 2/1982 | European Pat. Off. . | |
| 2487043 | 1/1982 | France | 122/388 |

*Primary Examiner*—Henry C. Yuen
*Assistant Examiner*—Steven E. Warner
*Attorney, Agent, or Firm*—L. A. DePaul

[57] ABSTRACT

A steam generator is provided which contains a manifold with a plurality of nozzles for breaking up and washing away sludge which has formed on the upper surface of its tube sheet. The manifold is rigidly attached to the upper surface of the tube sheet and remains in place during conventional operation of the steam generator. The portions of the present invention which are contained within the steam generator do not contain any moving parts and, thus, does not require human intervention in close proximity to components of the steam generator which may be possibly radioactive. High velocity streams of water are used to break up and remove sludge from the upper surface of the tube sheet and openings are provided through the wall of the steam generator for removal of the slurry in which the sludge is entrained.

3 Claims, 5 Drawing Figures

SLUDGE REMOVING APPARATUS FOR A STEAM GENERATOR

BACKGROUND AND SUMMARY OF THE INVENTION

The present invention relates generally to steam generators and, more particularly, to steam generators which are provided with a means for removing sludge deposits from its tubesheet.

A steam generator which is designed to be utilized within nuclear reactor systems generally comprises a cylindrical envelope which forms a pressure-confining shell. This cylindrical shell is usually disposed in such a way that its central axis is in a vertical position. Within the shell, a generally flat plate is disposed in such a way that it divides the internal portion of the steam generator into two major cavities. This plate, herein after referred to as a tubesheet, is further provided with a plurality of holes through which tubes are extended.

The lower portion of the steam generator, beneath the tubesheet, is formed into two essentially identical compartments. Each of these compartments is in the shape of a quarter-sphere and each of these compartments has the tubesheet as its upper boundary. Furthermore, the bottom portion of the steam generator shell is hemispherical and defines the lower portion of each of these two compartments. A vertical partition wall is provided to separate this hemispherical portion into the two quarter-spherical compartments.

Tubes, which extend through the tubesheet, provide fluid communication between the two quarter-spherical compartments by extending from one compartment, through the tubesheet, into the upper portion of the steam generator and back through the tubesheet in fluid communication with the other compartment. Since the two compartments are both located beneath the tubesheet, the tubes traverse a U-shaped path in order to provide fluid communication between the two compartments while extending into the upper regions of the steam generator.

In the upper region of the steam generator, secondary water is contained by the steam generator's shell and this volume of water is maintained in thermal communication with the outer surfaces of the tubes. In operation, a constant supply of water at a high temperature is provided in a first one of the two quarter-spherical compartments. The water passes into the tubes at the region where they extend, through the tubesheet, into that compartment. Due to differential pressures, the water passes upward through the tubes and along the U-shaped path defined by them. After passing through the tubes, the water flows into the second of the two quarter-spherical compartments and subsequently exits from the steam generator. As this hot water passes through the tubes, heat is transferred to the secondary water, by thermal conduction, through the walls of the tubes.

The primary water supply, which passes through both quarter-spherical chambers and through the tubes, is supplied from a nuclear reactor or some other heat producing apparatus. The secondary water, which is maintained within the shell of the steam generator in its upper portion and is in thermal communication with the primary water through the walls of the U-shaped tubes, is thereby heated and converted to steam which is eventually conducted to a steam turbine. It should be apparent from the above description that the primary and secondary water supplies are prevented from mixing together. This type of steam generator system enables a nuclear reactor to be used to generate heat for use by a steam turbine in such a way that prevents radioactive water from passing in fluid communication with the steam turbine of an electrical power generating station.

As the radioactive primary water passes through the U-shaped tubes, this water yields part of its heat by vaporizing the secondary water which is contained in the upper portion of the steam generator's shell and which surrounds the tubes. As this steam is produced, it is removed from the upper portion of the steam generator and conducted to a turbine which is associated with an electric generator. After being used to drive the turbine, the secondary water is condensed and eventually reintroduced into the upper portion of the steam generator. It has been found that, over long periods of operation, sediments can accumulate at the base of the tubes on the upper surface of the tubesheet. These sediments consist mainly of iron oxides although they may also contain precipitates of other compounds. The presence of a sludge, formed by these sediments on the upper surface of the tubesheet, can create tube corrosion phenomena which could potentially cause leaks in the tubes and permit the primary water to mix with the secondary water in the steam generator. Impurities, such as cobalt or entrained gaseous fission products, within the primary water supply are radioactive due to the flow of the primary water through the nuclear reactor.

If tube corrosion occurs, expensive repairs may be required and the steam generator may therefore be out of productive service for an unacceptable length of time. Since the primary water is typically under approximately 2200 psia and the secondary water is under approximately 1000 psia, a very small leak in a heat exchanger tube can lead to a flow of primary water into the secondary system. Larger leaks, which would occur if a tube ruptures, would cause a significant flow of primary water into the secondary system and, if not immediately identified and corrected, could lead to a major disruption of the power plant's operation. Therefore, periodic maintenance procedures are generally performed to remove sludge buildup at the base of the tubes where they are connected to the tubesheet at its upper surface.

U.S. Pat. No. 3,916,844 which issued to Cassell on Nov. 4, 1975, illustrates one possible approach for removing the sludge buildup in a steam generator. According to that invention, the sludge is removed by an arrangement of baffles within the steam generator's shell which define a settling chamber. The baffles retard the flow of secondary water and, essentially, effect an abrupt change in the secondary water's direction of flow so that suspended particles can settle out of the secondary water. By using a blowdown pipe, continuous or periodic flushing of this settling chamber can be effected. European Pat. No. 67,739 which issued to Jean-Claude Yazidjian on Dec. 22, 1982 illustrates a different concept in removing sludge from the upper portion of the tubesheet of a steam generator. In contrast to the Cassell patent, the Yazidjian invention comprises movable water lances which can be manipulated to direct a stream of fluid against the upper surface of the tubesheet in order to break up the sludge which had settled thereon. The sludge lances extend through the wall of the steam generator in a generally horizontal direction and can be manipulated by human effort in order to direct the stream of fluid towards different portions of the tubesheet. A portion of the steam generator's shell is shaped to receive the lance therethrough in sliding communication. Another fluid lancing method is disclosed in U.S. Pat. No. 4,079,701 issued to Hickman et al. on Mar. 21, 1978. This patent describes a technique which forces the sludge to the periphery of the tubesheet by maneuvering a movable fluid lance along the tubesheet diameter.

To date, efforts which have been directed to the removal of sludge from steam generator tubesheets have significant disadvantages. The methods which utilize stationary components generally require the steam generator to undergo elaborate design changes in order to form settling chambers in which the flow of the secondary water is retarded. This approach is illustrated in the Cassell patent described above. Other methods of removing sludge from the tubesheets of steam generators require interactive human participation in their operation and also require a means for extending a work tool through the wall of the steam generator in such a way that freedom of motion is provided but where human exposure to radioactive components is minimized. The Yazidjian patent is illustrative of this latter philosophy of operation.

In order to provide adequate removal of sludge buildup on the tubesheet of a steam generator without the necessity of elaborate design changes is a desirable goal. Since it is a goal in the nuclear industry to keep human exposure to radioactive components as low as reasonably achievable, it is advantageous to reduce or eliminate the requirement for human interaction with the sludge removing apparatus in order that radioactive exposure of human beings is significantly reduced or eliminated entirely.

The present invention provides a sludge removal apparatus which does not require a significant design change of typical steam generators and which, although it responds to the procedural dictates of a human operator, does not require the exposure of a human being to potentially radioactive components of the steam generator.

The present invention utilizes a manifold which is rigidly attached to the upper surface of a steam generator's tubesheet. The manifold is provided with a central conduit therethrough which has at least two termini. One of this conduit's termini is connected in fluid communication with a means for providing a flow of fluid from an external source into the manifold's conduit. Another termini of the manifold's conduit is connected in fluid communication with a means for directing a stream of fluid in a desired direction. Normally, this directing means is a nozzle through which the externally supplied fluid can pass. The function of the nozzle is to not only direct the fluid in a desired direction but also to increase the velocity of the fluid as it passes through the nozzle's aperture. In a sludge removing apparatus made in accordance with the present invention, the nozzle is directed in line with a lane which is formed by two rows of tubes extending from the tubesheet. The means for providing a flow of water from an external source to the manifold can be a length of tubing which extends from the manifold, through the steam generator's wall, to a water pump. At the region where thus tubing passes through the steam generator's wall, no relative movement between the wall and the tubing is required and, therefore, adequate sealing can be provided so that the manifold and its associated nozzle and tubing can remain in place during normal operation of the steam generator. Between the wall of the steam generator and the pump, valving means is provided so that the flow of water to the above-mentioned nozzle can be restricted at the desire of the operator. It should further be apparent that, by placing the pump at a significant distance from the steam generator, the valve can be placed at a distance from the steam generator which removes the human operator of the valve from any appreciable exposure from potentially radioactive components that are located within the shell of the steam generator.

By providing the manifold with a plurality of internal conduits, each being independent from one another, and by further providing each of these separate conduits with its own nozzles and tubing system, it should be apparent that a sludge removing apparatus made in accordance with the present invention can provide a plurality of independent fluid circuits that are independently operable. If each of the circuits is provided with its own valve, water can be selectively supplied to each of the nozzles independently from the operation of other nozzles. This characteristic permits a water pump of a given size to be used to serially remove sludge from different lanes between the tubes of the steam generator. This characteristic has the advantage of eliminating the need for an extremely large capacity pump that would otherwise be required if all of the nozzles of the present invention were operated simultaneously.

A preferred embodiment of the present invention comprises a plurality of the individual conduits within the manifold and each of these individual conduits is connected in fluid communication to a plurality of nozzles. Although a preferred embodiment of the present invention comprises approximately six nozzles connected to each of the individual conduits, this is not a requirement. The manifold can be extended along a center line of the tubesheet which would generally extend in the same direction as the vertical wall which separates the steam generators' two lower compartments described above. It should be understood that, depending on the particular geometry of the tube layout configuration, the manifold may be placed at other locations above the tubesheet in order to avoid obstruction of the tubes or other components within the secondary water portion of the steam generator.

Since the present invention provides a flow of water into the region above the tubesheet, some means for removing this water is required. In a preferred embodiment of the present invention, the water is removed from the upper surface of the tubesheet by providing at least one opening in the wall of the steam generator proximate the upper portion of the tubesheet. This opening permits the water, in which a quantity of sludge is entrained, to be removed from the upper portion of the steam generator and either filtered or discarded. In a preferred embodiment of the present invention, this water and sludge mixture can be filtered to remove the sludge and then recirculated to the pump. Depending on the quantity of sludge to be removed, it may not be practical to provide a closed water system in which the sludge is removed by filters. Instead, a constant supply of fresh water would be injected toward the sludge by the nozzles and, after being removed through the above-described opening, it would be stored for a later removal and disposal of the entrained sludge particles.

It should be apparent that the present invention is applicable to both new steam generator installations and, as a retrofit, to existing steam generators which are in operation. The manifold of the present invention is intended to be bolted or otherwise fastened rigidly to the upper surface of the tubesheet and to remain rigidly attached to the tubesheet during normal operation of the steam generator. It should be understood, however, that during sludge removal procedures, the secondary water would be drained from the steam generator prior to the operation of the present invention.

BRIEF DESCRIPTION OF THE DRAWINGS

The present invention will be more fully understood by a reading of the Description of the Preferred Embodiment in conjunction with the drawings in which.

DESCRIPTION OF THE PREFERRED EMBODIMENT

The present invention relates generally to steam generators and, more particularly, to a steam generator which is equipped with a stationary sludge removing device.

Figure 1:
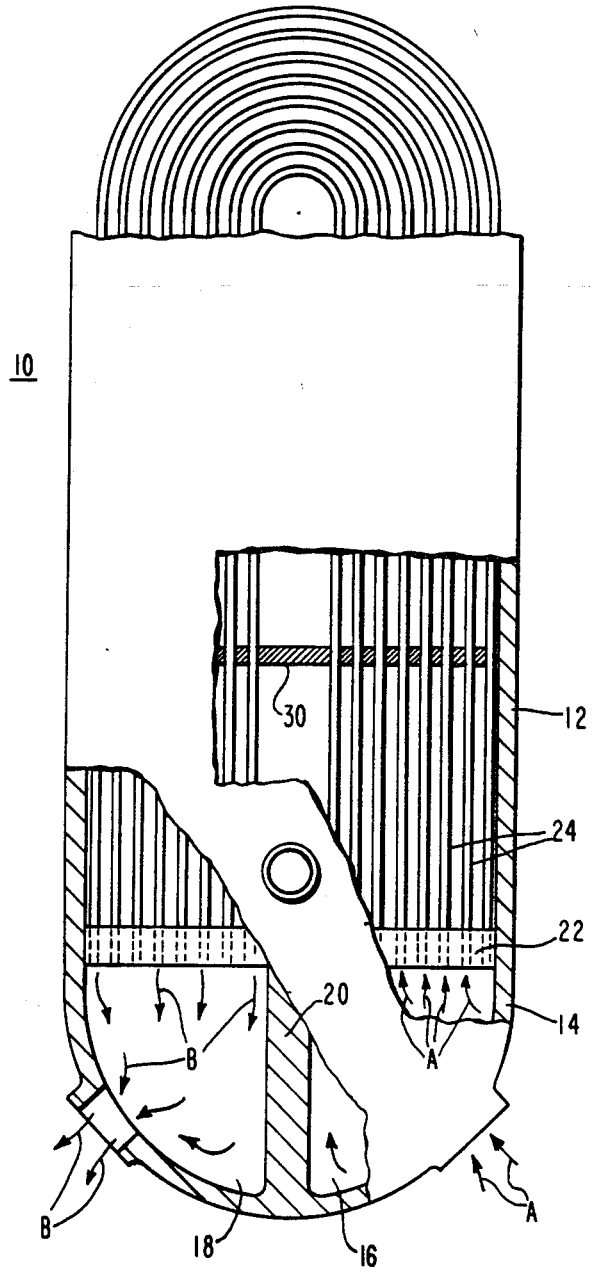
FIG. 1 schematically illustrates a typical steam generator.

FIG. 1 illustrates an exemplary steam generator for use in conjunction with a nuclear powered electrical generating facility. The steam generator 10 has a generally cylindrical outer shell 12 which is shaped to contain fluids under high pressure. A lower portion 14 of the steam generator is hemispherical in shape and is divided into a first 16 and second 18 compartment. A generally vertical wall structure 20 divides the hemispherical lower portion 14 of the steam generator 10 into these two quarter-spherical compartments, 16 and 18. A generally flat plate 22 is disposed within the steam generator 10 in such a way so as to divide its internal portion into two major regions. The plate 22, hereinafter referred to as a tubesheet, has a plurality of holes extending through it. Each of the holes is shaped to receive a preselected end of a U-shaped tube 24. The tubes 24 extend from the tubesheet 22 into an upward direction and, after traversing U-shaped paths, provide fluid communication between the first 16 and second 18 quarter-spherical compartments in the lower region 14 of the steam generator 10. As can be seen in FIG. 1, the tubes 24 are U-shaped and pass through the tubesheet 22 at appropriate locations which permit fluid communication between the two lower compartments, 16 and 18, of the steam generator 10. As further illustrated in FIG. 1, a fluid can therefore pass into the first compartment 16 and upward into the tubes 24. After passing along the U-shaped path defined by the tubes 24, this fluid can exit from the tubes 24 into the second compartment 18. Therefore, if a fluid is introduced into the first compartment 16 as illustrated by arrows A, it can pass through the tubes 24 and into the second compartment 18 as illustrated by arrows B prior to flowing out of the steam generator 10. This primary flow of water, or other suitable fluid, is at an elevated temperature from having passed through the core of a nuclear reactor and therefore contains radioactive particles.

If a quantity of a liquid is provided above the tubesheet 22 within the upper portion of the steam generator 10, that secondary liquid will be in thermal communication with the outer surface of the tubes 24. The shell 12 of the steam generator 10 will contain this liquid above the tubesheet 22. If a thermally hot primary liquid is introduced into the first compartment 16 as illustrated by the arrows A, it will pass through the tubes 24 and therefore be in thermal communication with the secondary liquid in the upper portion of the steam generator 10 for a period of time as it passes through the tubes 24. After losing some of its heat to the secondary fluid, this primary fluid will then pass out of the tubes 24 and into the second compartment 18 prior to its exit from the steam generator 10 as illustrated by arrows B. A steam generator of a nuclear power plant operates as discussed above by introducing thermally hot water, which contains radioactive particles, into one quarter-spherical compartment 16 of a steam generator 10, passing that primary water through U-shaped tubes 24 and then removing the water from a second compartment 18. This water, which passes through both lower compartments, 16 and 18, is radioactive and herein referred to as the primary water. Above the tubesheet 22, the secondary supply of water is prevented from coming into direct contact with the primary water by the methods described above.

It should be apparent from the above description that a steam generator 10 as illustrated in FIG. 1 permits a secondary water supply to be heated by a primary water supply without the two coming in contact with each other. Although not shown in FIG. 1, the steam generator 10 is provided with a means for removing steam from its upper portion and conducting that steam to a steam turbine which is associated with an electrical generator. The plurality of tubes 24 are partially supported by the support plates 30 and are rigidly attached to the tubesheet 22 at their lower portions. The tubes 24 are welded into the tubesheet 22 in such a way that no fluid can pass through the tubesheet 22 without passing through the tubes 24.

It has been found in practice that, over a long period of operation, sediments can be deposited from the secondary water onto the upper surface of the tubesheet 22 and around the bottom portions of the tubes 24. These sediments, which form a sludge, can consist mainly of iron oxides, but are not so limited. The existence of this sludge along the upper surface of the tubesheet 22 and around the bottom portions of the tubes 24, can contribute to corrosion of the tubes 24. Even when the chemical nature of the sludge itself is not corrosive, it can create artificial crevices between itself and the tubes 24 which act as corrosion accelerators. A crevice around the tubes 24 is a chemical concentrating situation which can lead to eventual corrosion of the tubes 24. It should be apparent that corrosion of the tubes 24 can lead to a failure of their integrity and permit a mixing of the primary and secondary water supplies or result in costly downtime to make necessary repairs.

In order to prevent corrosion of the tubes 24, it is customary to periodically remove the sludge from the upper surface of the tubesheet 22. Although various types of apparatus, as discussed above, have been used in the past to remove this sludge, the present invention has significant advantages over them. A sludge removing device made in accordance with the present invention is rigidly attached to the tubesheet 22 and remains within the steam generator 10 during its normal operation. Furthermore, the present invention does not require intervention by a human operator in close proximity to the steam generator 10 and does not require any means of sealing a passage through the wall 12 of the steam generator in order to permit a sludge lancing tool to pass therethrough in sliding relation. The removal of a human operator from close proximity with the internal components of a steam generator is in conformance with the goal of reducing the radioactive exposure of human operators to a value which is as low as reasonably achievable.

Figure 2:
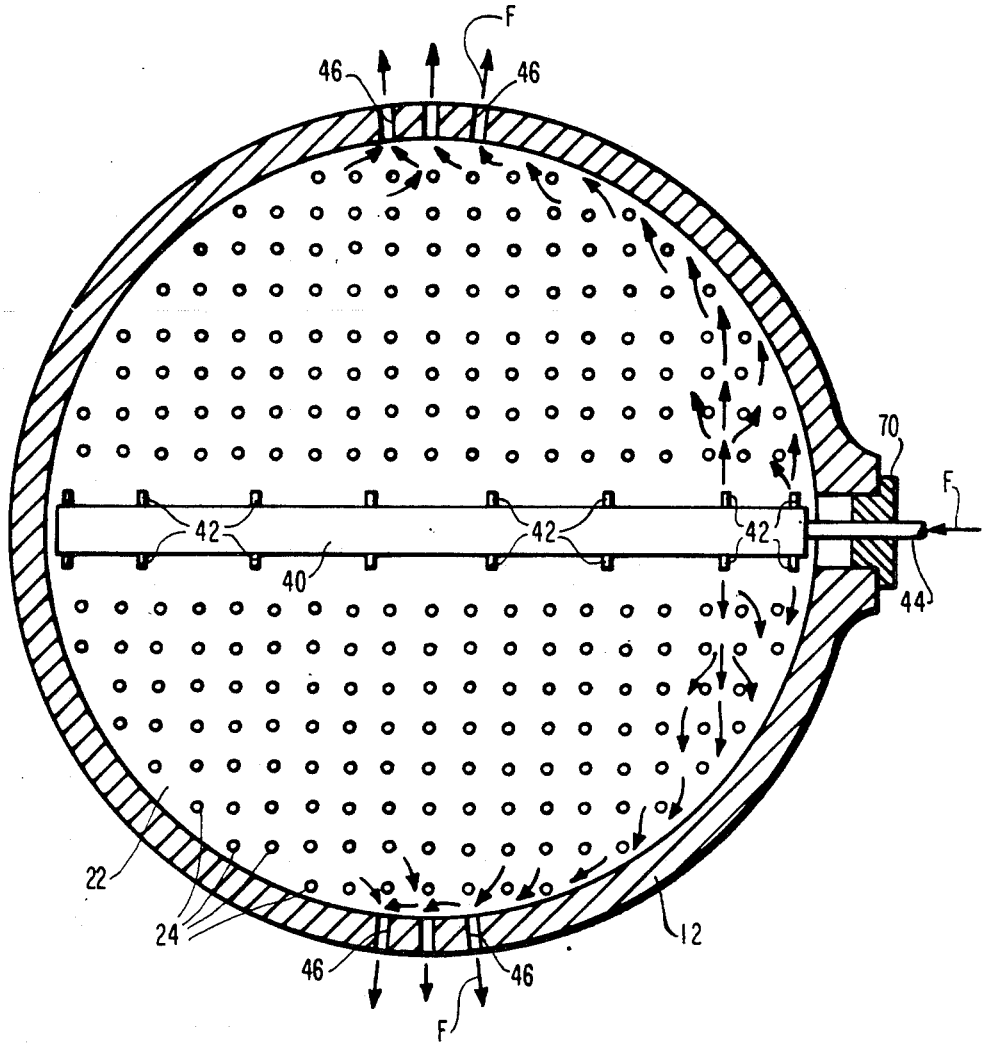
FIG. 2 illustrates a section view of a steam generator, looking down on the tubesheet, with the present invention disposed in place.

FIG. 2 illustrates a section view of an exemplary steam generator and shows the shell 12 of the steam generator enclosing a region above the tubesheet 22. Also shown in FIG. 2 are a plurality of tubes 24 passing through the tubesheet 22. The plurality of tubes 24 are arranged in rows which describe a plurality of lanes therebetween. A manifold 40 of the present invention is shown extending along a diameter of the tubesheet 22. In typical steam generator designs, there exists a tubeless region of the tubesheet along a diameter. This tubeless region is the result of the presence of the dividing wall (reference numeral 20 in FIG. 1) which divides the lower portion of the steam generator into two quarter-spherical compartments. Since the tubes 24 pass, in a U-shaped path, between the two compartments, no tubes extend through the tubesheet 22 in the region immediately above the wall which divides the two quarter-spherical compartments. It should be understood that the tubes 24 illustrated in FIG. 2 pass from one half of the tubesheet 22 to the other. In the illustration shown in FIG. 2, each of the tubes which is located on one side of the manifold 40 passes in a U-shaped configuration to the other side of the manifold 40. Therefore, the number of circular illustrations of the cross-sections of tubes 24 shown in FIG. 2 is twice that of the actual number of tubes of the steam generator.

A plurality of nozzles 42 are attached to the manifold 40. Within the manifold 40 is at least one fluid conduit connected in fluid communication with the nozzles 42. This conduit (not illustrated in FIG. 2) has at least two termini. One terminus is connected to a nozzle 42 and the other terminus is connected in fluid communication with tubing 44 or any other means for providing a flow of fluid into the conduit of the manifold 40.

As shown in FIG. 2, a fluid can pass in the direction illustrated by arrows F through the tubing 44 and into a conduit within the manifold 40. After passing through the internal conduit, the fluid can exit through a nozzle 42 and into a lane which is defined between two rows of tubes 24. The fluid is illustrated in FIG. 2 as exiting from four nozzles 42 and passing along the upper surface of the tubesheet 22 before leaving the steam generator through openings 46 in its wall 12. As the fluid passes out of the nozzles 42, its velocity is increased to a magnitude which is sufficient to break up and carry away any sludge which exists on the upper surface of the tubesheet 22. This sludge is carried away by the water toward the openings 46 and out of the steam generator. Although not shown in FIG. 2, it should be apparent that the openings 46 could be associated with a filtering means which is capable of removing the sediment from the flushing fluid.

Also illustrated in FIG. 2 is the fact that two of the nozzles 42 can be selectively utilized without the involvement of others of the plurality of nozzles 42 which are connected to the manifold 40. This selective use is made possible by the incorporation of a plurality of individual conduits within the manifold 40. Of course, it should be understood that when a plurality of independent conduits are provided within the manifolds 40, more than one piece of tubing 44 is required.

Figure 3:
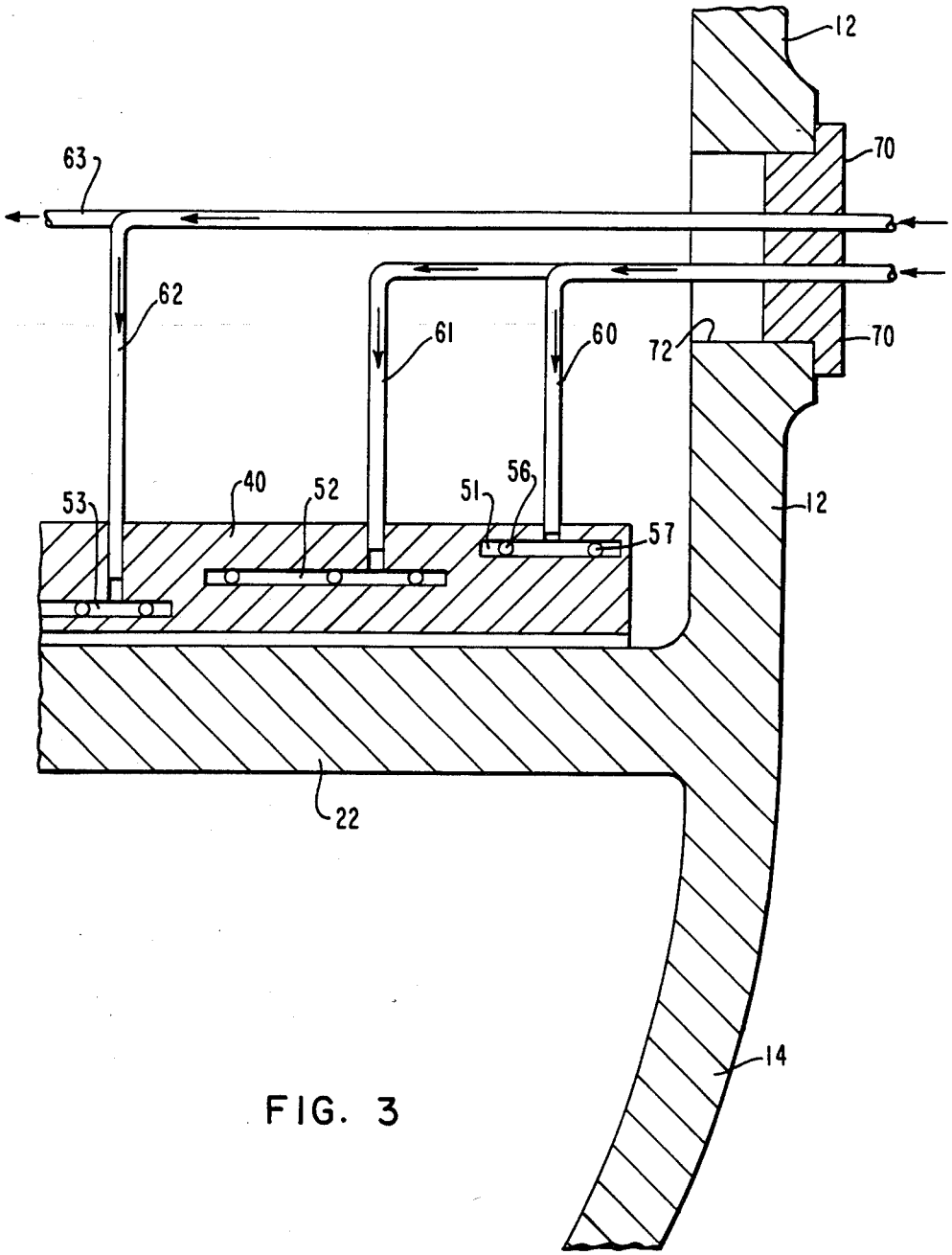
FIG. 3 shows a sectional view of a portion of a steam generator with the present invention.

In order to more particularly describe the aspect of the present invention in which a plurality of conduits are provided within the manifold 40, FIG. 3 illustrates a cross-sectional view of the present invention. The manifold 40 is illustrated with three individual conduits, 51, 52 and 53, disposed therein. Conduit 51 has, for example, two ports, 56 and 57, connected in fluid communication with it. Each of these two ports, although not illustrated in FIG. 3, can be connected in fluid communication with a nozzle (reference numeral 42 in FIG. 2). The conduit 51 is also connected in fluid communication with a tube 60 which extends through a portion of the wall 12 of the steam generator. It should be understood that, by passing a fluid through the tube 60 and into the conduit 51, that fluid will be selectively passed through the nozzles which are connected to the ports 56 and 57. Although each of the other two conduits, 52 and 53, are shown as having ports capable of being placed in fluid communication with nozzles, the flow through tube 60 would not pass through those nozzles. Therefore, it should be apparent that by providing the manifold 40 with a plurality of independent internal conduits, 51, 52 and 53, a fluid can be selectively routed to predetermined nozzles without the involvement of other nozzles which are connected to other conduits. In FIG. 3, conduit 52 is connected in fluid communication with tube 61 and conduit 53 is connected in fluid communication with tube 62. Although not shown in FIG. 3, other conduits within the manifold 40 can be provided and other tubes, such as tube 63, would be connected in fluid communication to them.

The manifold 40 is rigidly connected to the tubesheet 22 in order that it can remain in place during normal operation of the steam generator. As shown in FIG. 3, the tubes, 60, 61, 62 and 63, pass through the wall 12 of the steam generator. In FIG. 3, a plug 70 is shown covering an opening 72 in the shell 12 of the steam generator. The plug 70 is rigidly attached to the shell 12 and the tubes are rigidly attached to the plug 70 in such a way so as to prevent the passage of the secondary fluid out of the steam generator during normal operation. Each of the tubes which are illustrated in FIG. 3 can be provided with a means for preventing a flow of fluid therethrough. This preventing means would typically comprise a valve which is connected in fluid communication with a preselected tube and located at a distance remote from the steam generator between the steam generator and an external fluid source, such as a pump.

It is anticipated that the nozzles which are disposed at each end of the manifold 40 would be used to conduct a flow of water while any other nozzles are being used. As can be seen in FIG. 2, the end nozzles are directed to cause a stream of water along the interface between the tubesheet 22 and the shell 12. This has the beneficial effect of washing the sludge toward the holes 46 instead of allowing it to collect along the shell 12. In FIG. 3, for example, ports 56 and 57 would be used simultaneously with any other ports on that half of the manifold 40.

Although this method of usage is not a requirement of the present invention, it improves the sludge removal procedure.

Figure 4:
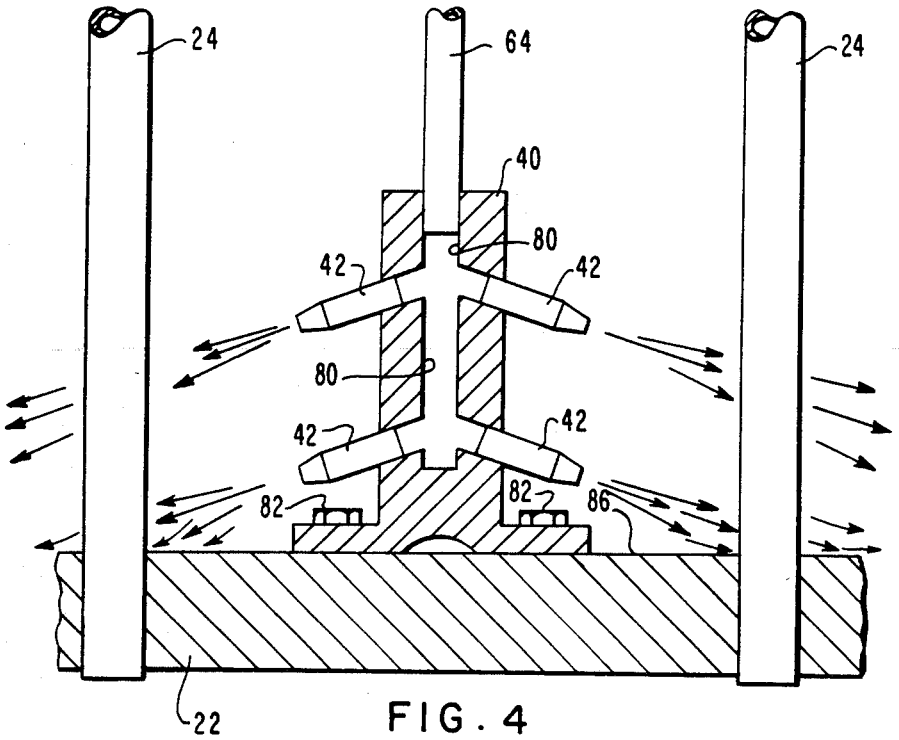
FIG. 4 illustrates a sectional view of the present invention attached to a tubesheet of a steam generator.

FIG. 4 illustrates a sectional view of the present invention. The manifold 40 is provided with one or more conduits therein. In FIG. 4, the manifold 40 is shown as having a vertically extending conduit 80 which permits a fluid passage from a tube 64 to a plurality of nozzles 42. Although the four nozzles 42 shown in FIG. 4 are disposed in such a way that they extend in opposite directions and are located with two of the nozzles 42 placed above two others of the nozzles 42, it should be understood that many other configurations are possible within the scope of the present invention. The particular configuration which is illustrated in FIG. 4 was chosen to show fluid communication being provided between a single tube 64 and a plurality of nozzles 42. The nozzles could have alternatively been disposed along a common horizontal plane (as illustrated in FIG. 3).

The manifold 40 is shown being rigidly attached to the tubesheet 22 by bolts 82. This rigid attachment of the manifold 40 to the tubesheet 22 permits the present invention to remain in place within the steam generator during its normal operation.

Also shown in FIG. 4 are two tubes 24 which are illustrative of the plurality of U-shaped tubes disposed in rows as illustrated in FIG. 2. The fluid which is provided through the tubing 64 passes through the conduit 80 and, then, is accelerated and passes out of the nozzles 42 as shown. The streams of water are directed towards the upper surface 86 of the tubesheet 22 in such a way so as to break up and remove any sludge which has accumulated thereon. The nozzles 42 are shown extending from the manifold 40 in such a way so as to direct a stream of water downward toward the upper surface 86 of the tubesheet 22. The precise angle of the nozzles 42 in relation to the manifold 40 is not critical. A variety of angular relationships is possible within the scope of the present invention and can vary according to the particular application.

Figure 5:
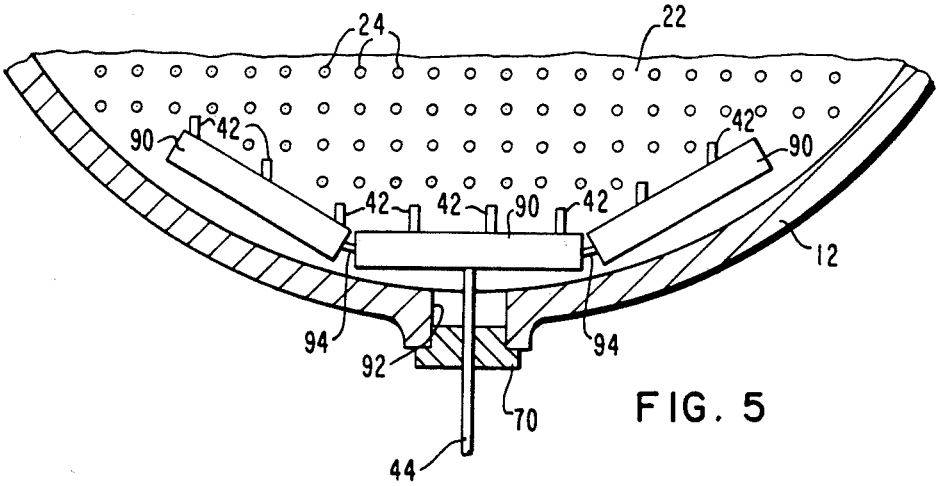
FIG. 5 illustrates an alternate embodiment of the present invention disposed within a steam generator.

FIG. 5 illustrates an alternative embodiment of the present invention in which a segmented manifold 90 is utilized. In FIG. 5, a section of a steam generator is shown with its tubes 24 and tubesheet 22 being confined within a shell 12. In this respect, FIG. 5 is similar to FIG. 2. However, FIG. 5 further exemplifies the situation in which the present invention can be utilized when it is less convenient to dispose the manifold along the center line of the tubesheet 22, as illustrated in FIG. 2. For example, in steam generators which have a cylindrical pipe vertically disposed through the center of the tubesheet, this central opening provides a convenient means for collecting the sludge when this embodiment of the present invention is disposed along the outer periphery of the tubesheet as shown in FIG. 5. Furthermore, it may not be desirable to extend the present invention over this opening in the manner which would be required if it is disposed along the tubesheet's diameter. In applications where it is not feasible to dispose the manifold along the tubesheet's diameter, the embodiment which is illustrated in FIG. 5 can be used.

It should be understood that the segmented manifold 90 is shaped so that it can be passed through an opening 92 in the shell 12 of the steam generator. Each of the segmented manifold sections is connected in fluid communication with each other by a suitable conduit means 94. The internal construction of the manifold sections 90 is similar to that illustrated in FIG. 4 and discussed above with a plurality of nozzles 42 connected in fluid communication with the manifold's internal conduits and also in fluid communication with a tube 44 which permits a supply of fluid to be provided into the manifolds 90. As discussed above, the tubing 44 is passed through a plug 70 which is shaped to fit into the opening 92. As in the preferred embodiment of the present invention, a pump is used to supply a continuous stream of water through the tube 44 and a means is provided for removing the fluid from the upper surface of the tubesheet 22 such as through a central cylindrical opening through the surface of the tubesheet.

Although the present invention has been described in considerable detail, it should not be considered to be so limited and other alternative embodiments should be considered to be within its scope.

What I claim is:

1. A nuclear steam generator comprising:

a generally cylindrical outer shell;

a generally flat tubesheet disposed in said outer shell;

a plurality of U-shaped tubes disposed within said outer shell and mounted in said tubesheet for conducting a nuclear reactor coolant therethrough and defining a tubeless lane on said tubesheet extending along a diameter of said tubesheet and defining a peripheral lane on said tubesheet and between said tubes and said outer shell; and a manifold attached to said tubesheet and disposed in said tubeless lane with said manifold having a plurality of independent internal first conduits with each of said first conduits terminating near the outer surface of said manifold in alignment between rows of said tubes and with each of said first conduits having at last two terminal ports with a nozzle disposed in each of said ports and directed from said manifold in generally opposite directions for simultaneously discharging fluid therefrom in substantially opposite directions and for selectively and independently directing fluid streams against said tubesheet for dislodging sludge deposits therefrom, and with said manifold having an independent internal second conduit with said second conduit terminating near said outer surface of said manifold with a nozzle disposed therein and in alignment with said peripheral lane for selectively and independently directing a fluid stream against said tubesheet for entraining said dislodged sludge deposits for removal from said steam generator.

2. A nuclear steam generator comprising:

a generally cylindrical outer shell;

a generally flat tubesheet disposed in said outer shell, a plurality of U-shaped tubes disposed within said outer shell and mounted in said tubesheet for conducting a nuclear reactor coolant therethrough and defining a tubeless lane on said tubesheet extending along a diameter of said tubesheet and defining a peripheral lane on said tubesheet and between said tubes and said outer shell; and a manifold attached to said tubesheet and disposed in said peripheral lane with said manifold having a plurality of independent internal first conduits with each of said first conduits terminating near the outer surface of said manifold in alignment between rows of said tubes for selectively and independently directing fluid streams against said tubesheet for disloding sludge deposits therefrom, and with said manifold having an independent internal second conduit with said second conduit terminating near said outer surface of said manifold in alignment with said peripheral lane for selectively and independently directing a fluid stream against said tubesheet for entraining said dislodged sludge deposits for removal from said steam generator.

3. The steam generator according to claim 2 wherein said steam generator further comprises a nozzle disposed in at least one of said conduits.

* * * * *